US009988253B1

(12) United States Patent
Robinett et al.

(10) Patent No.: US 9,988,253 B1
(45) Date of Patent: Jun. 5, 2018

(54) LIFTING JACK SYSTEM AND METHOD OF USE

(71) Applicants: Briton Robinett, Lubbock, TX (US); Bruce Robinett, Lubbock, TX (US)

(72) Inventors: Briton Robinett, Lubbock, TX (US); Bruce Robinett, Lubbock, TX (US)

( * ) Notice: Subject to any disclaimer, the term of this patent is extended or adjusted under 35 U.S.C. 154(b) by 0 days. days.

(21) Appl. No.: 15/720,605

(22) Filed: Sep. 29, 2017

Related U.S. Application Data

(60) Provisional application No. 62/402,420, filed on Sep. 30, 2016.

(51) Int. Cl.
*B66F 3/22* (2006.01)
*B66F 3/02* (2006.01)
*B66F 17/00* (2006.01)

(52) U.S. Cl.
CPC ..... *B66F 3/02* (2013.01); *B66F 17/00* (2013.01)

(58) Field of Classification Search
CPC ..... B66F 1/00; B66F 1/04; B66F 3/14; B66F 3/16; B66F 3/18; B66F 5/00
See application file for complete search history.

(56) References Cited

U.S. PATENT DOCUMENTS 1,482,846 A * 2/1924 Harrah ..... B66F 1/06 254/133 R
3,614,064 A * 10/1971 Bennett ..... B60S 9/02 254/418
D248,460 S * 7/1978 Dunn ..... B60S 9/02 D34/31
4,978,104 A * 12/1990 Gipson, Jr. ..... B60D 1/66 254/420
5,421,555 A * 6/1995 Sims ..... B60D 1/66 254/420
6,543,305 B1 * 4/2003 Van Cor ..... F16H 3/363 74/348
7,303,210 B2 * 12/2007 Baxter ..... B60S 9/08 254/418
7,331,567 B2 * 2/2008 Li ..... F16B 7/14 248/354.6
7,722,011 B1 * 5/2010 Edwards ..... B66F 1/06 254/100

(Continued)

*Primary Examiner* — Lee D Wilson
(74) *Attorney, Agent, or Firm* — Richard G. Eldredge; Eldredge Law Firm

(57) ABSTRACT

A lifting jack system includes a lifting bar; having a track of teeth running vertical along one edge of the lifting bar; and a foot secured to a base of the lifting bar; a lifting head secured around the lifting bar and vertically moveable along the track of teeth; a nose, extending outward from the lifting head for securing to an item to be raised; a gear system housed within the lifting head, the gear system having a safety gear with asymmetrical teeth; a spring loaded pawl engaged with the teeth of the safety gear; and a round gear with symmetrical teeth engaged with the teeth of the safety gear and the track of teeth of the lifting bar; and a ratchet bar secured by a ratchet to the safety gear and extending outwardly from the lifting head; the ratchet bar is to turn the safety gear via the ratchet, thereby engaging the safety gear with the round gear, the round gear then engaging with the track of teeth to raise the lifting head along the track of teeth; and the spring loaded pawl engages with the safety gear to prevent downward movement of the lifting head.

5 Claims, 4 Drawing Sheets

(56) References Cited

U.S. PATENT DOCUMENTS

| | | | | |
|---|---|---|---|---|
| 8,162,290 | B1 * | 4/2012 | Tracy | B66F 1/06<br>254/133 R |
| 9,809,204 | B2 * | 11/2017 | Young | B60S 9/04 |
| 2006/0237700 | A1 * | 10/2006 | Thomas | B60S 11/00<br>254/133 R |

* cited by examiner

LIFTING JACK SYSTEM AND METHOD OF USE

BACKGROUND

1. Field of the Invention

The present invention relates generally to lift systems, and more specifically, to a lifting jack system for improved safety during use.

2. Description of Related Art

Lift systems are well known in the art and are effective means to raise and lower large items such as vehicles. For example, FIG. 1 depicts a conventional lifting jack system 101 having a handle 103 in communication with a lifting head 105 by a ratchet 107, the lifting head 105 having a nose 109 and vertically moveable along a bar 111 by a series of climbing pins 113. During use, the nose 109 is placed under a large item, such as a vehicle, and the handle 103 and ratchet 107 are used to raise the lifting head 105 along the bar 111, thereby lifting the item.

One of the problems commonly associated with system 101 is ineffective safety. For example, the ratchet 107 wears out over time, thereby allowing the lifting head 105 to fall during use, creating the potential for serious injury.

Accordingly, although great strides have been made in the area of lifting jack systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
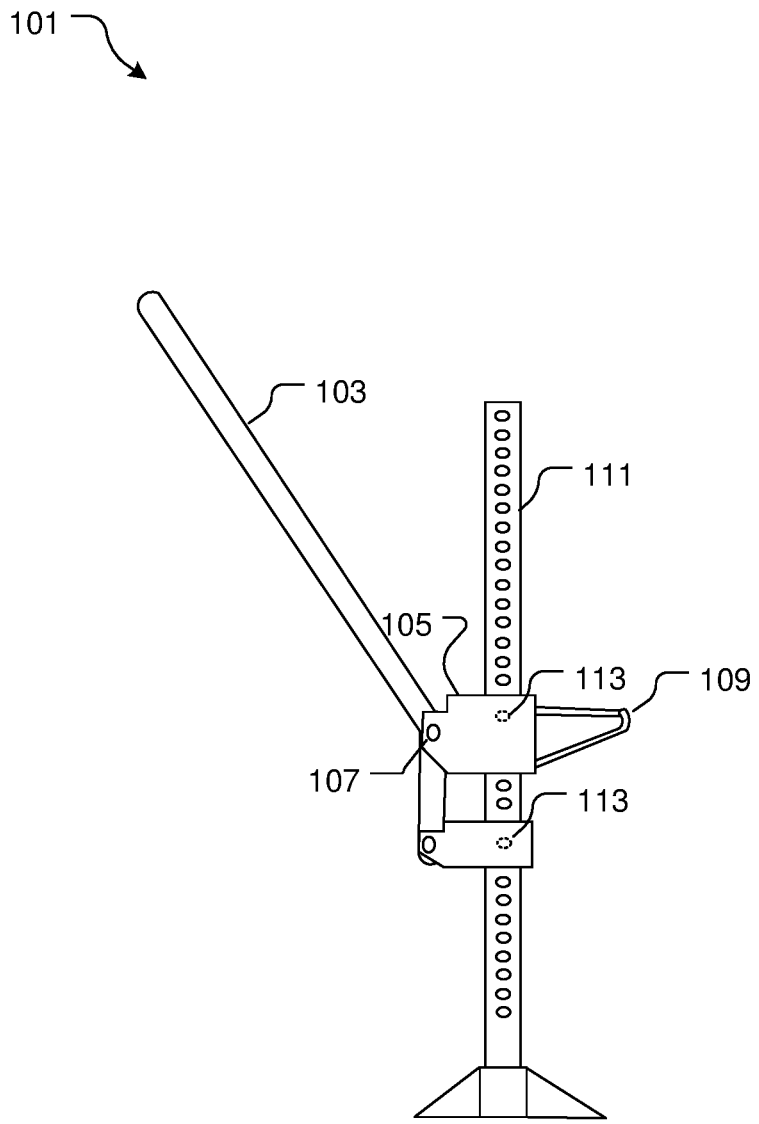
FIG. 1 (Prior Art)
FIG. 1 is a side view of a common lifting jack system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional lift systems. Specifically, the present invention provides a lifting system with improved safety. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
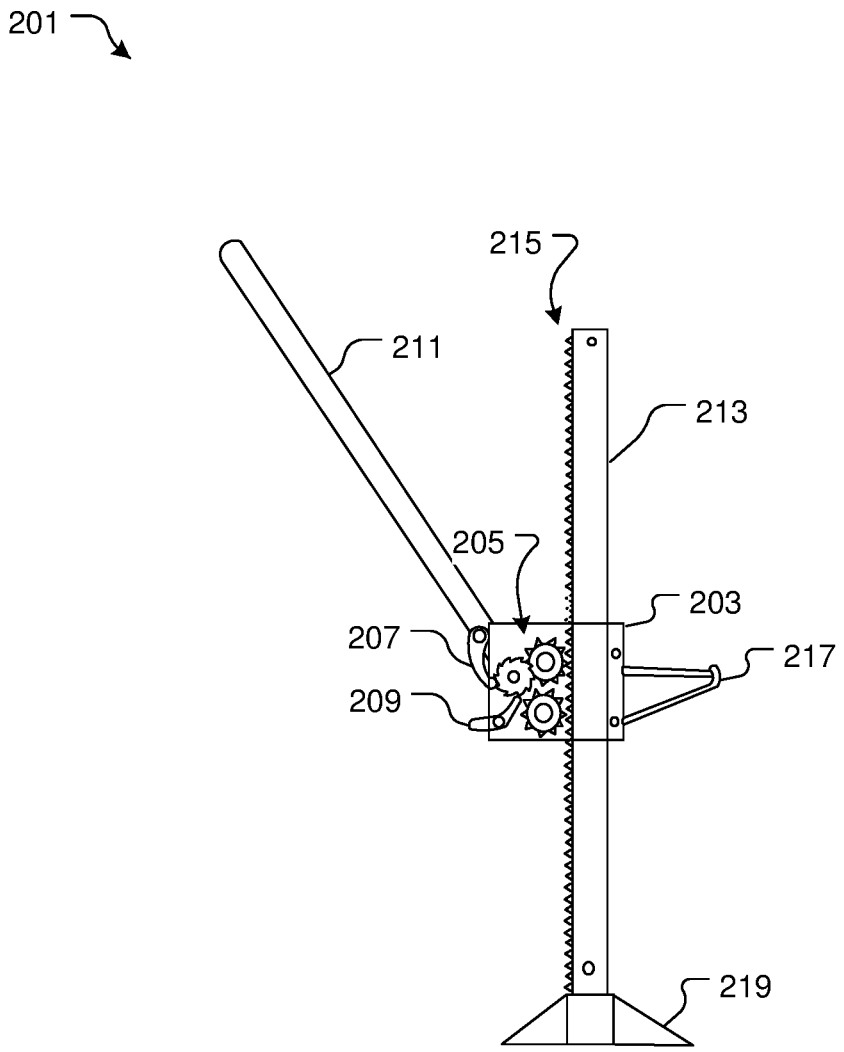
FIG. 2 is a side view of a lifting jack system in accordance with a preferred embodiment of the present application.

Referring now to the drawings wherein like reference characters identify corresponding or similar elements throughout the several views, FIG. 2 depicts a side view of a lifting jack system in accordance with a preferred embodiment of the present application. It will be appreciated that system 201 overcomes one or more of the above-listed problems commonly associated with conventional lift systems.

In the contemplated embodiment, system 201 includes a lifting head 203, housing a gear system 205 having a plurality of gears and one or more spring loaded pawls 207, 209, wherein the gear system 205 is engaged by a ratchet bar 211, and the lifting head 203 is vertically moveable along a lifting bar 213 by a track of teeth 215. In the contemplated embodiment, system 201 includes a nose 217 secured to the lifting head 203 and a foot 219 secured to the base of the lifting bar 213.

Figure 3:
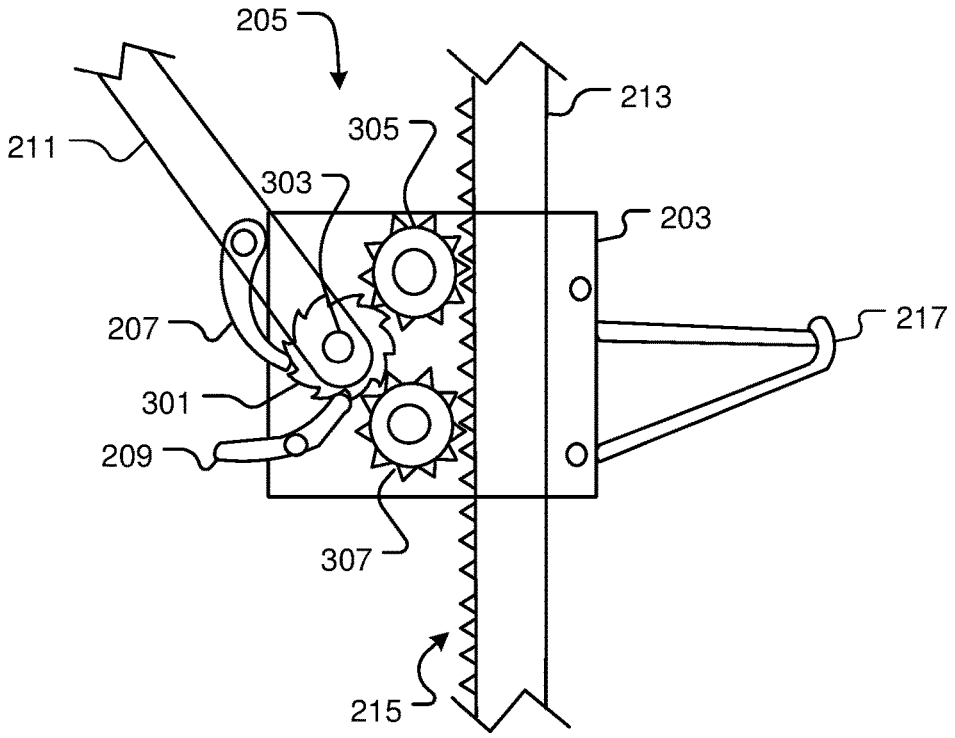
FIG. 3 is a side view of the gear system from FIG. 2.

In FIG. 3 a side view of the gear system 205 is shown. In the preferred embodiment, the gear system 205 comprises a safety gear 301, with asymmetrical teeth, secured by a ratchet 303 to the ratchet bar 211 and engaged with a spring loaded pawl 207 attached to the ratchet bar 211 and a second spring loaded pawl 209 secured within the lifting head 203. In addition, in the contemplated embodiment, the gear system 205 includes one or more round gears 305, 307 with substantially symmetrical teeth, turned by the safety gear 301 and engaged with the track of teeth 215. It is further contemplated that each gear can be coated in a plastic polymer, such as nylon, thereby improving durability and longevity.

Figure 4:
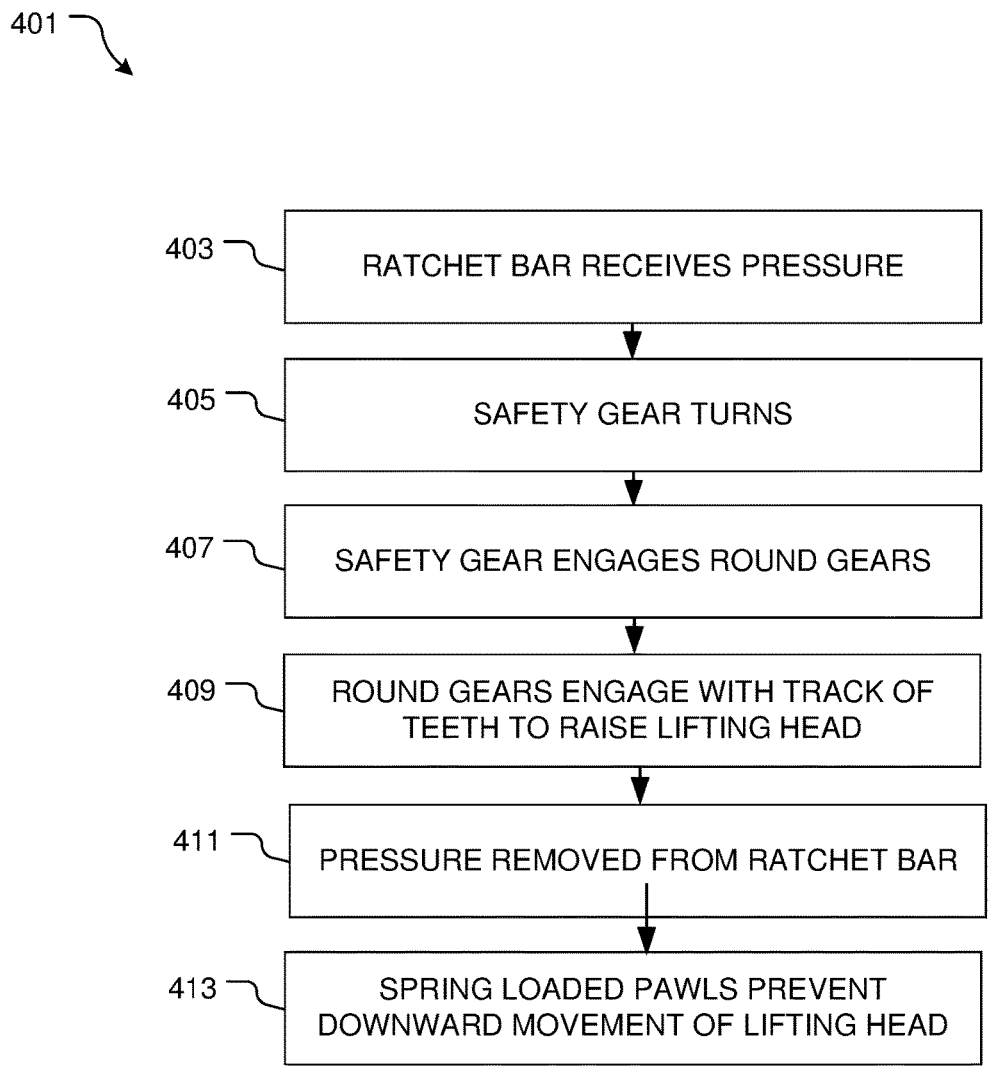
FIG. 4 is a flowchart of the method of FIG. 2.

In FIG. 4 a flowchart 401 depicts the method of system 201. During use, pressure is applied to the ratchet bar 211, thereby turning the safety gear 301, as shown with boxes 403, 405. The safety gear 301 engages with the two round gears 305, 307, thereby turning the gears which further engage with the track of teeth 215 to raise the lifting head 203 along the lifting bar 213, as shown with boxes 407, 409. When pressure is removed from the ratchet bar 211, the spring loaded pawls 207, 209 engage with the teeth of the safety gear 301 and prevent downward movement along the lifting bar 213, as shown with boxes 411, 413.

It should be appreciated that one of the unique features believed characteristic of the present application is combination of features present in the gear system. It should be appreciated that the use of spring loaded pawls 207, 209 with the safety gear 301 will improve safety by allowing the upward movement and preventing downward movement of the lifting head 203. In addition, the plastic polymer coating of the gears will reduce gear slippage to further prevent a malfunction of system 201. It should be appreciated that multiple spring loaded pawls allows for improved safety, as one pawl can fail, while the remaining pawl stays engaged, thereby preventing slipping of the gear system. In addition, it is contemplated that the gear system can be wholly contained within lifting head 203, thereby preventing users from coming into contact with the one or more gears.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A lifting jack system, comprising:

a lifting bar; having:

a track of teeth running vertical along one edge of the lifting bar; and a foot secured to a base of the lifting bar;

a lifting head secured around the lifting bar and vertically moveable along the track of teeth;

a nose, extending outward from the lifting head for securing to an item to be raised;

a gear system housed within the lifting head, the gear system having:

a safety gear with asymmetrical teeth;

a spring loaded pawl engaged with the teeth of the safety gear; and a round gear with symmetrical teeth engaged with the teeth of the safety gear and the track of teeth of the lifting bar; and a ratchet bar secured by a ratchet to the safety gear and extending outwardly from the lifting head;

wherein the ratchet bar is configured to turn the safety gear via the ratchet, thereby engaging the safety gear with the round gear, the round gear then engaging with the track of teeth to raise the lifting head along the track of teeth; and wherein the spring loaded pawl engages with the safety gear to prevent downward movement of the lifting head.

2. The system of claim 1, wherein the spring loaded pawl is attached to the ratchet bar and configured to extend to engage with the safety gear.

3. The system of claim 1, wherein the spring loaded pawl is attached to the lifting head and configured to extend to engage with the safety gear.

4. The system of claim 1, wherein the safety gear and the round gear are coated in a plastic polymer.

5. A method of lifting an item with a jack, the method comprising:

providing the system of claim 1;

placing the nose associated with the lifting head underneath the item; and applying pressure repeatedly to the ratcheting bar;

wherein the safety gear engages with the round gear to move the lifting head along the track of teeth; and wherein the spring loaded pawl prevents downward movement of the lifting head.

* * * * *